United States Patent [19]

Melwisch et al.

[11] Patent Number: 4,928,389

[45] Date of Patent: May 29, 1990

[54] SHAVING HEAD FOR A DRY-SHAVING APPARATUS

[75] Inventors: Harald Melwisch, Klagenfurt; Norbert Schneider, Ebental, both of

[73] Assignee: U.S. Philips Corp., New York, N.Y.

[21] Appl. No.: 103,079

[22] Filed: Sep. 29, 1987

[30] Foreign Application Priority Data

Oct. 3, 1986 [AT] Austria ..... 2629/86

[51] Int. Cl.[5] ..... B26B 19/02

[52] U.S. Cl. ..... 30/43.92; 30/346.51

[58] Field of Search ..... 30/43.92, 43.91, 43.9, 30/43

[56] References Cited

U.S. PATENT DOCUMENTS 4,009,518 3/1977 Locke et al. ..... 30/43.92

*Primary Examiner*—Douglas D. Watts

*Attorney, Agent, or Firm*—Ernestine C. Bartlett

[57] ABSTRACT

In a shaving head (4) for a dry-shaving apparatus comprising a shaving-head frame (5) for detachably mounting an arcuate shear foil (6) which at both ends of at least one of its two longitudinal edges (7, 8) comprises projections (11, 12, 13, 14) associated with slots (22, 23) in the adjacent side walls (20, 21) of the shaving-head frame, into which slots the projections can be inserted when the shear foil is mounted on the shaving-head frame, the shear foil being secured to the shaving-head frame by means of at least one raised portion (26, 27, 28) which comprises at least one ramp (29) which is upwardly inclined in the direction of insertion, which projects from the shaving-head frame, and which engages beneath the relevant longitudinal edge of the shear foil, at least one such raised portion on the longitudinal member of the shaving-head frame adjacent the relevant longitudinal edge of the shear foil is arranged at a distance from the slots in the side walls of the shaving-head frame which constitute the lateral guide means for the projections on the shear foil, said raised portion comprising a further ramp (30) which is downwardly inclined in the direction of insertion and which substantially adjoins the ramp (29) which is upwardly inclined in the direction of insertion.

9 Claims, 3 Drawing Sheets

SHAVING HEAD FOR A DRY-SHAVING APPARATUS

BACKGROUND OF THE INVENTION

The invention relates to a shaving head for a dry-shaving apparatus, comprising a shaving-head frame which comprises two longitudinal members and two side walls, for detachably securing an arcuate shear foil, which at both ends of at least one of its two longitudinal edges comprises projections which protrude from its transverse edges. These projections are associated with slots which are open at one side. The slots are formed in the adjacent side walls of the shaving-head frame and define the position of the shear foil on the frame. The projections can be inserted into the open ends of the slots during mounting of the shear foil on the shaving-head frame. The shear foil being secured to the shaving-head frame by means of at least one raised portion comprising a ramp which is upwardly inclined in the direction of insertion; which projects from the level of the longitudinal member of the shaving-head frame adjacent the relevant longitudinal edge of the shear foil; and which engages beneath the relevant longitudinal edge of the shear foil.

Such a shaving head is known from U.S. Pat. No. 4,009,518. In this known shaving head both longitudinal edges of the shear foil are provided with U-shaped reinforcement strips which comprise facing resilient tabs projecting from each of the two limbs of the U-shaped strips to form the projections on the lateral edges of the shear foil. Each of the slots in the side walls of the shaving-head frame which are associated with these projections on the shear foil is also associated directly with a raised portion provided at the location of the side wall at the open end of the relevant slot. These raised portions each comprise a ramp which is upwardly inclined in the direction of insertion of the projections in the slots and which at its end is bent perpendicularly to the slot wall, so that all in all the raised portions have a hook-shaped construction. When the projections are inserted into the slots the two tabs of the projections are pressed towards one another by the ramp of the raised portion, after which the tabs, once they have cleared the raised portion, spring away from each other to engage behind the hook-shaped bent part of the raised portion. To move the projections out of the slots for removing the shear foil from the shaving-head frame, the tabs of the projections must first be pressed towards one another to disengage them from the hook-shaped bent part of the raised portion and allow them to move past this portion.

In such a shaving head, removing the shear foil from the shaving-head frame, as is necessary for example for the purpose of cleaning or replacing the shear foil, is not simple because the tabs which engage in the slots are hardly accessible to be pressed towards one another. For this reason said U.S. Pat. No. 4,009,518 proposes the use of a pointed tool for removal of the shear foil. Apart from the fact that it is inconvenient for the user of such a dry-shaving apparatus that a special tool must be used for removing the shear foil from the shaving-head frame, removing the shear foil from the shaving-head frame by means of such a tool is not simple. For example, this tool can only be applied at the location of a slot, thus enabling removal of the shear foil from the shaving-head frame only step by step. Under these circumstances, it is not unlikely that the shear foil may be damaged by deformation.

SUMMARY OF THE INVENTION

An object of the invention is to construct a shaving head for a dry-shaving apparatus in such a way that the shear foil can be mounted simply and securely on and can also be removed simply from the shaving-head frame.

This and other objects are achieved in accordance with the invention, the longitudinal member of the shaving-head frame, which is situated adjacent the relevant longitudinal edge of the shear foil, carries at least one raised portion. The raised portions are arranged at a distance from the slots provided in the side walls of the shaving-head frame to form lateral guides for the projections on the shear foil, and which, substantially adjoining a first ramp which is upwardly inclined in the direction of insertion, comprises a further or second ramp which is downwardly inclined in the direction of insertion.

The invention is based on the idea of arranging a raised portion by means of which the shear foil is secured and over which it must be moved in a lateral direction. This movement is obtained by applying external force both when the shear foil is mounted on and is removed from the shaving-head frame at a location of the shaving-head frame where the relevant longitudinal edge of the shear foil during its cooperation with the raised portion can deflect to slide past this raised portion without the shear foil being permanently deformed. This means that the raised portion by means of which the shear foil is secured to the shaving-head frame is arranged at a distance from the lateral guides of the shear foil. The choice of the height of the raised portion in conjunction with the stiffness of the longitudinal edge of the shear foil determines the desired external force necessary to clear the raised portion.

During removal of the shear foil from the shaving-head frame the further or second ramp, in the same way as the first ramp during mounting of the shear foil on the shaving-head frame, constitutes a run-on surface enabling the relevant longitudinal edge of the shear foil to be slid over the raised portion by applying external force. Thus, to remove the shear foil from the shaving-head frame, only manual pressure is to be exerted on the curved portion of the shear foil, after which the foil becomes automatically detached from the shaving-head frame.

Mounting the shear foil on the shaving-head frame is equally simple. The shear foil is pre-curved by hand and inserted into the shaving-head frame with the curved portion in front and in such a way that its lateral projections engage the slots in the side walls of the shaving-head frame, until the longitudinal edge of the shear foil is deflected by and has moved past the raised portion. After such movement past the raised portion, the longitudinal edge of the shear foil resumes its stretched form and the raised portion engages beneath the foil. Since the laterally guided longitudinal edge of the shear foil in its stretched form cannot move over the raised portion without an external force being applied, the shear foil is securely attached on the shaving-head frame.

The slots in the side walls of the shaving-head frame which constitute lateral guides for the projections on the shear foil can be constructed in various ways. For example, these slots may have the same cross-section, adapted to the projections on the shear foil, over their entire length, so that the slots guide the projections on both sides over their full length. However, it is preferred that the slots have an extension which (a) extends in the direction of the raised portion, (b) begins substantially at the level of the end of the further or second ramp of the raised portion, which further or second ramp is downwardly inclined in the direction of insertion, and which (c) extends at least substantially up to the level of the beginning of the ramp of the raised portion, which ramp is upwardly inclined in the direction of insertion. By thus extending the slots, during mounting of the shear foil on the shaving-head frame, when the relevant longitudinal edge of the shear foil must be slid over the raised portion, its projections can deflect laterally in the extensions of the slots. Under these conditions the longitudinal edge of the shear foil need not be bent so far, which facilitates mounting because a smaller force is required. These extensions of the slots begin substantially at the level of the end of the ramp of the raised portion, which ramp is downwardly inclined in the direction of insertion, and extend in a direction opposite to the direction of insertion. This ensures that the shear foil is retained in its position on the shaving head frame, since in this position of the shear foil its projections engage in the parts of the slots without extensions, in which parts of the slots they are guided on both sides and thus cannot deflect. In this manner a relatively stronger deflection of the longitudinal edge of the shear foil and hence a relatively greater force is required to move the longitudinal edge onto the further or second ramp of the raised portion.

In this respect it is especially preferred that the extensions of the slots extend up to the open ends of the slots. This enables the projections of the shear foil to be inserted particularly easily into the open ends of the slots when said foil is mounted on the shaving-head frame.

The raised portion with the two ramps can be constructed in various ways. For example, the raised portion may be constructed as a truncated cone or as a spherical cap. However, it is found to be vary advantageous if the raised portion is ridge-shaped viewed in the direction of insertion. This results in a linear and consequently uniform cooperation of the raised portion with the relevant longitudinal edge of the shear foil, while in addition permitting easy removal of the shaving-head frame from the mold when the frame is manufactured by injection-molding. The raised portion disclosed in the afore-mentioned U.S. Pat. No. 4,009,518 also exhibits such a ridge-shaped construction, but as a result of its different hook-shaped construction and different position on the shaving head frame, namely at the open end of the slot, said raised portion functions in a completely different way than the present raised portion, as has already been explained, so that these raised portions cannot be considered to be the same.

In another preferred embodiment the longitudinal member of the shaving-head frame is provided with two raised portions whose mutual distance viewed in the longitudinal direction of the longitudinal member is at least equal to the distance between each raised portion and the adjacent side wall of the shaving-head frame. Thus, providing two raised portions ensures a particularly reliable mounting of the shear foil on the shaving-head frame, so that the external force to be applied to clear the raised portions not only depends on the height of the raised portions and the stiffness of the longitudinal edge of the shear foil but also on the mutual distance between the raised portions in conjunction with their distance to the adjacent side wall of the shaving-head frame. This again guarantees that the relevant laterally guided longitudinal edge of the shear foil, when it slides over the raised portions, can deflect so far that the shear foil can be mounted on and removed from the shaving-head frame without any problems and without damage to the shear foil.

In this respect it is especially preferred if, viewed in the longitudinal direction of the longitudinal member, the distance between the two raised portions is selected to be substantially twice the distance between each raised portion and the adjacent side wall of the shaving-head frame. Under these conditions very favourable practical results have been obtained with respect to the attachment of the shear foil to the shaving-head frame, its mounting on this frame, and its removability from this frame.

BRIEF DESCRIPTION OF THE DRAWINGS

An embodiment of the invention will not be described in more detail, by way of example, with reference to the accompanying drawings.

DETAILED DESCRIPTION OF PREFERRED EMBODIMENTS

Figure 1:
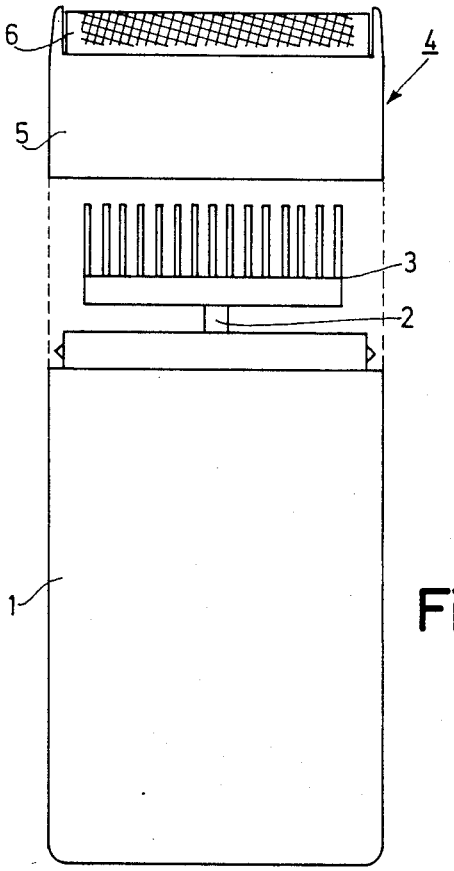
FIG. 1 shows a dry-shaving apparatus with the shaving head removed from the basic apparatus.

In FIG. 1 the reference numeral 1 denotes the basic part of a dry-shaving apparatus which contains a motor by means of which an oscillating lever 2 can be reciprocated. In a manner not shown a cutter 3 is arranged on the free end of the oscillating lever 2, so as to be resiliently movable in the axial direction of the oscillating lever 2, which cutter is constructed in known manner as a lamellar cutter. A shaving head 4 can be mounted on the basic part 1 of the apparatus and comprises a shaving-head frame 5 and a shear foil 6 which is adapted to cooperate with the cutter 3. The shear foil 6 is detachably mounted on the shaving-head frame 5 and occupies an arcuate position when mounted on this frame. When the shaving head 4 is mounted on the basic part 1 of the apparatus the cutter 3 is resiliently urged into the arcuate portion of the shear foil 6 in order to guarantee a correct shaving performance.

For cleaning purposes and replacement of the shear foil the shear foil must be detachable from the shaving-head frame. In order to ensure that such a dry-shaving apparatus can be handled as conveniently as possible by a user, mounting a shear foil on and removing it from the shaving-head frame should be as simple as possible and without the risk of the vulnerable shear foil being damaged. In addition, the shear foil should be securely attached to the shaving-head frame to ensure that it cannot inadvertently become detached from the shaving-head frame when the shaving head is removed from the basic part of the apparatus. In order to achieve this the following steps are taken.

Figure 2:
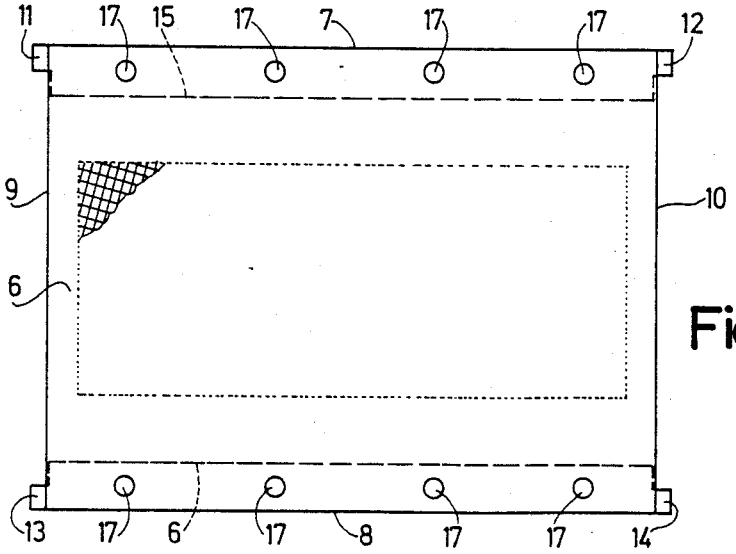
FIG. 2 is a plan view showing the surface of a shear foil which faces the skin during shaving.

As is shown in FIG. 2, on both ends of its two longitudinal edges 7 and 8 the shear foil 6 comprises projections 11, 12, 13 and 14 which protrude from its transverse edges 9 and 10. These projections may be formed, for example, directly by tabs which project from the shear foil. However, in the present case these projections are arranged on reinforcement strips provided on the longitudinal edges 7 and 8 of the shear foil. The reinforcement strip 15 arranged on the longitudinal edge 7 of the shear foil carries the projections 11 and 12 and the reinforcement strip 16 arranged on the longitudinal edge 8 of the shear foil carries the projections 13 and 14. The reinforcement strips 15 and 16 are arranged on the shear-foil surface which is remote from the skin during shaving, so that in FIG. 2 only the actual projections 11, 12, 13 and 14 are shown directly. Such reinforcement strips 15 and 16 may comprise, for example, metal strips which are spot-welded to the shear foil. In the present case the reinforcement strips 15 and 16 are made of a plastic material, said strips being secured to the shear foil by means of pin-shaped protrusions on these strips, which protrusions engage in corresponding holes in the shear foil and which are welded in position from the other side of the shear foil. In FIG. 2 these welding spots bear the reference numeral 17. Another possibility is to mould the plastic strips directly on the longitudinal edges of the shear foil, the projections 11, 12, 13 and 14 being formed at the same time.

Figure 3:
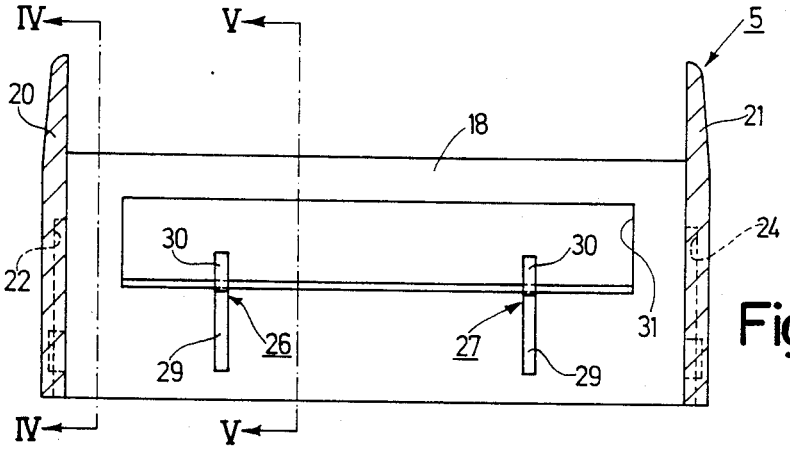
FIG. 3 is a longitudinal sectional view of a shaving-head frame which serves for detachably holding a shear foil.
Figure 4:
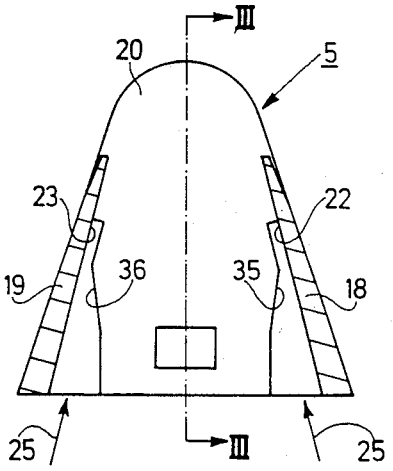
FIG. 4 shows the shaving-head frame in a sectional view taken on the line IV—IV in FIG. 3.
Figure 5:
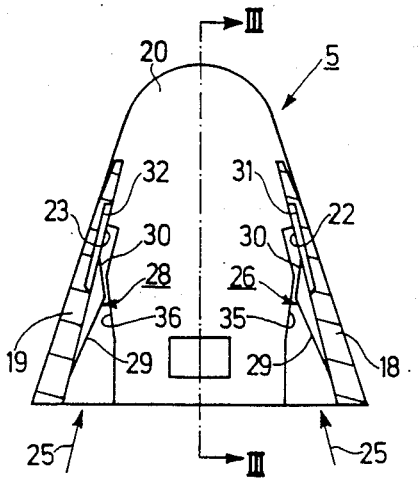
FIG. 5 shows the shaving-head frame in a sectional view taken on the line V—V in FIG. 3.

The shaving-head frame 5 shown in FIGS. 3, 4 and 5 comprises two longitudinal members 18 and 19 and two side walls 20 and 21. These side walls 20 and 21 are provided with slots which are open at one side and which are associated with the projections 11, 12, 13 and 14 on the shear foil, forming lateral guides for the projections 11, 12, 13 and 14 to define the position of the shear foil on the shaving-head frame. In FIGS. 4 and 5 those slots are visible which are associated with the projections 11 and 13, the slot 22 corresponding to the projection 11 and the slot 23 corresponding to the projection 13. FIG. 3 further shows the slot 24 corresponding to the projection 12. The slot corresponding to the projection 14 is not visible in FIGS. 3, 4 and 5 but is identical to the other slots 22, 23 and 24. To mount the shear foil on the shaving-head frame this foil is precurved in such a way that the surface which is to face the skin during shaving is situated at the outside, after which the foil is inserted into the shaving-head frame with the curve portion in front in the direction indicated by the arrow 25, the projections 11, 12, 13 and 14 on the foil being introduced into the open ends of the corresponding slots in the side walls 20 and 21 of the shaving-head frame 5.

In order to secure the shear foil to the shaving-head frame in such a way that it cannot become detached inadvertently, two ridge-shaped raised portions are provided on each of the two longitudinal members 18 and 19 of the shaving-head frame 4, which raised portions viewed in the direction of insertion of the shear foil into the shaving-head frame project above the level of the longitudinal members and edges behind the relevant longitudinal edges 7 and 8 of the shear foil int he shaving-head frame. These raised portions are arranged at a distance from the slots in the side walls 21 and 22 of the shaving-head frame, which slots form lateral guides for the projections on the shear foil.

Figure 6:
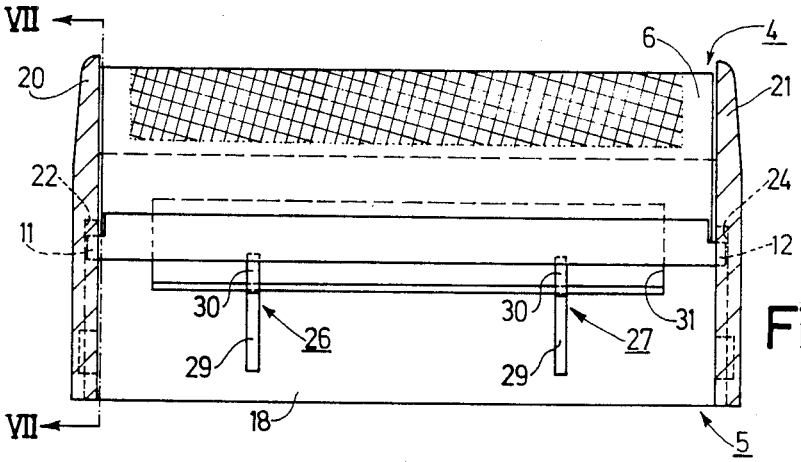
FIG. 6 is a longitudinal section view of a shaving head with a shaving-head frame as shown in FIG. 3 in which a shear foil as shown in FIG. 2 is mounted.
Figure 7:
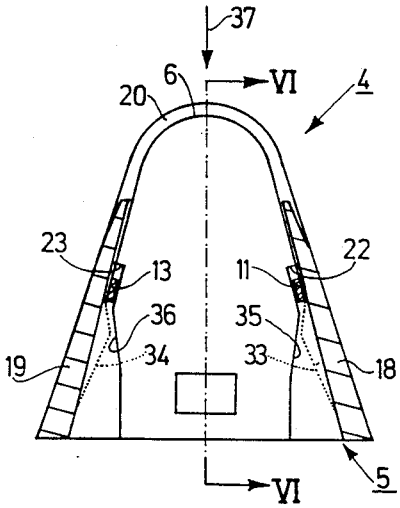
FIG. 7 shows the shaving head in a sectional view taken on the line VII—VII in FIG. 6, in which head a lateral edge of the shear foil is guided.

FIG. 3 shows the two raised portions 26 and 27 on the longitudinal member 18. In FIG. 5, of the two raised portions on the longitudinal member 18, the portion 26 is visible and of the two raised portions on the longitudinal member 19 the portion 28 opposite the raised portion on the longitudinal member 19, which is situated opposite the raised portion 27 on the member 18, is not shown in the Figures but is of the same construction as the portions 26, 27 and 28. Each of these raised portions comprises a ramp 29 which is upwardly inclined in the direction of insertion of the shear foil in the shaving-head frame, which direction corresponds to the direction of the arrow 25, and which is adjoined by a further ramp 30, which is downwardly inclined in the direction of insertion. If desired, a flat part may be provided on the raised portion between the ramps 29 and 30. In this way the ramps 29 guide the longitudinal edges 7 and 8 of the shear foil 6 when it is inserted into the shaving-head frame 5, the longitudinal edges further being laterally guided by the projections 11, 12, 13 and 14 in the corresponding slots in the side walls 21 and 22 of the shaving-head frame and being deflected until they have passed the raised portions, after which they resume their stretched shape. The position of the shear foil in the shaving-head frame is then determined by the projections 11, 12, 13 and 14 which engage in the slots in the side walls of the shaving-head frame. FIGS. 6 and 7 illustrate this position of the shear foil in the shaving-head frame.

Since the raised portions are ridge-shaped, a linear and hence uniform cooperation of the raised portions with the longitudinal edges of the shear foil is obtained. Moreover a shaving-head frame which is manufactured by injection-moulding is very easy to remove from the mold. It is to be noted that in the present case each of the two longitudinal members 18 and 19 of the shaving-head frame is formed with a recess 31 and 32 respectively which extends in the longitudinal direction of the relevant member, as can be seen in FIGS. 3, 5 and 6. These recesses 31 and 32 serve to take up the slightly projecting welds 17 on the shear foil when this foil is mounted on the shaving-head frame.

The ramps 30 of the raised portions prevent the shear foil from inadvertently becoming detached from the shaving-head frame, the longitudinal edges 7 and 8 of the shear foil abutting against these ramps if the projections 11, 12, 13 and 14 should tend to become disengaged from the slots. This can be seen in FIG. 7 in which the raised portions on the two longitudinal members 18 and 19, are not visible but are projected on the side wall 20 of the shaving-head frame as is indicated by the dotted lines 33 and 34. Without applying external force the longitudinal edges 7 and 8 of the shear foil which are laterally guided by their projections 11, 12, 13 and 14 in the slots in the side walls 20 and 21 of the shaving-head frame cannot deflect and move past the raised portions, so that such projections cannot slide out of these slots.

The height of the raised portions, their distance to the adjacent slots in the side walls of the shaving head frame which constitute lateral guides for the projections on the shear foil and the stiffness of the longitudinal edges of the shear foil together determine the external force to be applied in order to move the longitudinal edges of the shear foil over the raised portions, causing these edges to be deflected accordingly. Those skilled in the art will be able to adapt these criteria to one another in such a way that the external force required to move the longitudinal edges of the shear foil past the raised portions is so large that the shear foil is securely attached to the shaving-head frame and in such a way that the flexure of the longitudinal edges of the shear foil as they move past the raised portions remains within such limits that there is no risk of permanent deformation of the shear foil. In this respect it is found to be advantageous if the mutual distance between the two raised portions on a longitudinal member, viewed in the longitudinal direction of this member, is at least equal to the distance between each raised portion and the adjacent side wall of the shaving-head frame. In practice, it is found to be very effective if this mutual distance between the raised portions is substantially twice as large as the distance between each raised portion and the adjacent side wall of the shaving-head frame. With respect to the choice of the inclinations of the two ramps of each raised portion it is to be noted that these inclinations are only relevant in respect of the friction occurring when the longitudinal edges of the shear foil slide over the ramps, which friction is non-critical, so that in this respect the inclination of the ramps may be selected depending on the room available on the longitudinal members of the shaving-head frame.

As can be seen in FIGS. 4, 5 and 7, the slots 22 and 23 in the side wall 20 of the shaving-head frame each comprise an extension 35 and 36 respectively which extends in the direction of the raised portions 26 and 28, respectively, which begins substantially at the level of the end of the ramp 30 of the respective raised portion 26 and 28, which ramp is downwardly inclined in the direction of insertion, and which extends at least substantially up to the level of the beginning of the ramp 29 of the respective raised portion 26 and 28, which ramp is upwardly inclined in the direction of insertion, in the present case even up to the open end of the slot. The slots in the other side wall 21 of the shaving-head frame also have such extensions. In this way it is achieved that during mounting of the shear foil on the shaving-head frame the projections 11, 12, 13 and 14 on the shear foil can be inserted easily into the extended open ends of the corresponding slots in the side walls of the shaving-head frame which function as guide means and that the projections 11, 12, 13 and 14 on the shear foil can deflect sideways in the extensions of the slots as soon as the longitudinal edges 7 and 8 of the shear foil reach the raised portions and are moved over these portions, after which the projections 11, 12, 13 and 14, after leaving the extensions, are guided on both sides by the slots. This reduces the flexure of the longitudinal edges 7 and 8 of the shear foil when this foil is mounted on the shaving-head frame, so that a smaller force is required to move the longitudinal edges of the shear foil past the raised portions and this operation consequently proceeds more conveniently.

As is indicated in FIG. 7, the shear foil can be removed simply from the shaving-head frame by exerting manual pressure on the curved portion in the direction indicated by the arrow 37. The ramps 30 of the raised portions on the longitudinal members 18 and 19 of the shaving-head frame now constitute run-on surfaces enabling the longitudinal edges 7 and 8 of the shear foil to deflect in the same way as during mounting of the shear foil on the shaving-head frame, until they have cleared the raised portions, after which the projections 11, 12, 13 and 14 of the shear foil can slide out of the associated slots in the side-walls 20 and 21 of the shaving-head frame. In this respect it is to be noted that the said extensions 35 and 36 of the slots initially extend in a direction opposite to the direction of insertion substantially at the level of the end of the ramp 30 of the respective raised portion which is downardly inclined in the direction of insertion, as a result of which the projections 11, 12, 13 and 14 of the shear foil, when the longitudinal edges 7 and 8 of this foil run onto the ramps 30 of the raised portions, are still guided on both sides by the slots, so that they cannot deflect sideways. This means that at least when the longitudinal edges 7 and 8 of the shear foil begin to run onto the ramps 30 of the raised portions these edges have to be deflected relatively further to enable them to run onto these ramps, which continues until the projections 11, 12, 13 and 14 of the shear foil reach the extensions of the slots. During removal of the shear foil from the shaving-head frame the force to be applied initially is greater than during mounting of the shear foil on the shaving-head frame, preventing the shear foil from inadvertently becoming detached from the shaving-head frame in a special manner and enabling the shear foil to be mounted on the shaving-head frame in a very convenient manner.

When the shaving head 4 is mounted on the basic part of the apparatus the spring-loaded cutter 3 ensures that the shear foil 6 with its projections 11, 12, 13 and 14 is urged up to the closed ends of the corresponding slots in the side walls 21 and 22 of the shaving-head frame, the cutter being resiliently pressed into the curved portion of the shear foil. The projections which are guided on both sides in the slots then also ensure that the shear foil together with the cutter can give way uniformly in conformity with the shaving pressure.

Obviously, a series of modifications to the embodiment of the invention described in the foregoing are possible without departing from the scope of the invention. For example, on each of the two longitudinal members of the shaving-head frame only one raised portion may be provided, which is then preferably arranged in the center. If desired, more than two raised portions may be provided on each of the two longitudinal members of the shaving-head frame. There are also several possibilities of constructing the raised portions, provided that they comprise the two ramps which during mounting of the shear foil on and removal of the shear foil from the shaving-head frame constitute run-on surfaces for the longitudinal edges of the shear foil which is laterally guided in the slots in the side walls of the shaving-head frame with its projections, allowing the raised portions to be cleared only when an appropriate external force is applied. For example, the raised portions may also have a conical or partly spherical shape. Similarly, there are various possibilities of constructing the slots which laterally guide the projections on the shear foil, depending on the extent to which and the parts of the slots where a lateral deflection possibility for the projections on the shear foil is required. If desired, it is also possible to attach the shear foil to the shaving-head frame at only one longitudinal edge of the shear foil in a manner as described in the foregoing, in which case the other longitudinal edge of the shear foil can be attached in accordance with the prior art, for example by means of hooks on the longitudinal member of the shaving-head frame which engage in corresponding recesses at the location of the longitudinal edge of the shear foil.

What is claimed is:

1. A shaving head for a dry-shaving apparatus which comprises:

a shaving-head frame which comprises two longitudinal members, two side walls and slots with open ends formed in the side walls;

an arcuate shear foil detachably secured to said shaving-head frame, said foil having longitudinal edges and comprising at both ends of at least one of its longitudinal edges projections which are insertable into the open ends of the shaving-head frame slots during mounting of the shear foil on the shaving-head frame; and at least one raised portion for securing the shear foil to the shaving-head frame and which is carried by one of said longitudinal members of the shaving-head frame adjacent a longitudinal edge of the shear foil and at a distance from said slots, wherein:

said raised portion comprises a first ramp which is upwardly inclined in the direction of insertion, which ramp projects from the shaving-head frame and engages beneath a longitudinal edge of the shear foil; and wherein said raised portion also comprises a second ramp which is downwardly inclined in the direction of insertion and which substantially adjoins said first ramp.

2. A shaving head as claimed in claim 1, wherein the slots have an extension which extends in the direction of the raised portion, beginning substantially at the level of the end of said second ramp.

3. A shaving head as claimed in claim 2, wherein the extensions of the slots extend up to the open ends of the slots.

4. A shaving head as claimed in claim 1, wherein the raised portion is ridge-shaped viewed in the direction of insertion.

5. A shaving head as claimed in claim 1, wherein the longitudinal member of the shaving-head frame is provided with two raised portions are provided whose mutual distance, viewed in the longitudinal direction of the longitudinal member, is at least equal to the distance between each raised portion and the adjacent side wall of the shaving-head frame.

6. A shaving head as claimed in claim 5, wherein, viewed in the longitudinal direction of the longitudinal member, the distance between the two raised portions is selected to be substantially twice the distance between each raised portion and the adjacent side wall of the shaving-head frame.

7. A shaving-head as claimed in claim 1 wherein said slots form lateral guides for the projections of the shear foil.

8. A shaving-head as claimed in claim 1 wherein said longitudinal members of said shaving-head frame carry two raised portions.

9. A shaving-head for a dry-shaving apparatus which comprises:

a shaving-head frame (5) for detachably mounting an arcuate shear foil (6) therein, said shaving-head frame comprising longitudinal members (18, 19) and sidewalls (20, 21); said shear foil having at both ends of at least one of its two longitudinal edges (7, 8) projections (11, 12, 13, 14) which are associated with slots (22, 23) in the adjacent sidewalls (20, 21) of the shaving head frame, which slots form lateral guides for the projections (11, 12, 13 and 14) and into which slots the projections are inserted when the shear foil is mounted on the shaving-head frame;

said shear foil being secured to the shaving-head frame by at least one raised portion (26, 27, 28) on one of the longitudinal members (18, 19), which raised portion comprises at least a first ramp (29) projecting from the shaving-head frame and which is upwardly inclined in the direction of insertion and engages beneath a longitudinal edge of the shear foil; wherein (a) said at least one raised portion (26, 27, 28) of a longitudinal member (18, 19) of the shaving head frame adjacent the longitudinal edge (7, 8) of the shear foil is arranged at a distance from the slots in the side walls (20, 21); and (b) said raised portion further comprises a second ramp (30) which is downwardly inclined in the direction of insertion and which substantially adjoins the first ramp (29).

* * * * *